US011339756B2

(12) United States Patent
Ittlinger

(10) Patent No.: US 11,339,756 B2
(45) Date of Patent: May 24, 2022

(54) INJECTOR HAVING AN IMPROVED SOLENOID ACTUATOR

(71) Applicant: Robert Bosch GmbH, Stuttgart (DE)

(72) Inventor: Ralph Ittlinger, Weissach (DE)

(73) Assignee: Robert Bosch GmbH, Stuttgart (DE)

( * ) Notice: Subject to any disclaimer, the term of this patent is extended or adjusted under 35 U.S.C. 154(b) by 680 days.

(21) Appl. No.: 16/093,234

(22) PCT Filed: Mar. 24, 2017

(86) PCT No.: PCT/EP2017/057073
§ 371 (c)(1),
(2) Date: Oct. 12, 2018

(87) PCT Pub. No.: WO2017/194242
PCT Pub. Date: Nov. 16, 2017

(65) Prior Publication Data

US 2021/0215126 A1 Jul. 15, 2021

(30) Foreign Application Priority Data

May 13, 2016 (DE) ..... 102016208288.4

(51) Int. Cl.
*F02M 51/06* (2006.01)
*B05B 1/30* (2006.01)
*F02M 61/16* (2006.01)

(52) U.S. Cl.
CPC ..... *F02M 51/061* (2013.01); *B05B 1/3053* (2013.01); *F02M 61/168* (2013.01); *F02M 2200/8084* (2013.01)

(58) Field of Classification Search
CPC ..... F02M 51/061; F02M 51/0614; F02M 61/168; F02M 63/0007; F02M 2200/80; F02M 2200/8084; B05B 1/3053
See application file for complete search history.

(56) References Cited

U.S. PATENT DOCUMENTS 6,679,435 B1 1/2004 Noller et al.
2002/0040524 A1* 4/2002 Noller ..... F02M 51/0614 29/890.124
2003/0175137 A1* 9/2003 Inoue ..... F04B 1/0439 417/470

(Continued)

FOREIGN PATENT DOCUMENTS

CN 1155920 A 7/1997
CN 1190453 A 8/1998

(Continued)

OTHER PUBLICATIONS

International Search Report for PCT/EP2017/057073, dated Jun. 22, 2017.

*Primary Examiner* — Cody J Lieuwen
(74) *Attorney, Agent, or Firm* — Norton Rose Fulbright US LLP; Gerard Messina

(57) ABSTRACT

An injector is described for injecting a fluid, in particular a fuel, comprising a solenoid actuator for operating a closing element, which releases and closes a through opening, the solenoid actuator including an armature which is connected to the closing element, an internal pole and an external magnetic circuit component, and the magnetic circuit component is a rolled magnetic sleeve made from a strip material.

8 Claims, 2 Drawing Sheets

(56) References Cited

U.S. PATENT DOCUMENTS

| | | | | |
|---|---|---|---|---|
| 2010/0281691 | A1* | 11/2010 | Seitter | H01F 7/1607<br>29/890.132 |
| 2012/0153052 | A1* | 6/2012 | Nakajima | F02M 51/0675<br>239/533.2 |
| 2013/0200284 | A1* | 8/2013 | Hiyama | F16K 31/0668<br>251/129.15 |

FOREIGN PATENT DOCUMENTS

| | | | |
|---|---|---|---|
| CN | 1241241 | A | 1/2000 |
| CN | 1115478 | C | 7/2003 |
| CN | 1877111 | A | 12/2006 |
| CN | 101539085 | A | 9/2009 |
| EP | 1059647 | A1 | 12/2000 |
| EP | 1062421 | A1 | 12/2000 |
| JP | 554123304 | U | 8/1979 |
| JP | H04112640 | A | 4/1992 |
| JP | H04358763 | A | 12/1992 |
| JP | 2003269295 | A | 9/2003 |
| JP | 2004032895 | A | 1/2004 |
| JP | 2007016774 | A | 1/2007 |
| WO | 2005061150 | A1 | 7/2005 |

* cited by examiner

INJECTOR HAVING AN IMPROVED SOLENOID ACTUATOR

FIELD OF THE INVENTION

The present invention relates to an injector for injecting a fluid, in particular a fuel, the injector having an improved solenoid actuator.

BACKGROUND INFORMATION

Injectors for injecting fluids in the form of fuel injectors are known in different embodiments from the related art. For cost reasons, as well, solenoid actuators are generally used for inducing an opening and/or closing process of the injector. The solenoid actuator normally includes an electrically actuable coil, an armature connected to a closing element, an internal pole, and an external magnetic circuit component which forms the magnetic circuit in conjunction with the internal pole. The magnetic circuit is usually extrusion-coated with plastic. In the process, a labyrinth seal is introduced into a magnetic cup-like body that forms the magnetic circuit. However, the labyrinth seal works only with the most rectangular geometry possible. For that reason, the external magnetic circuit component is usually produced from a cylinder material using a machining process. In addition, an injector in which an internal pole is formed as a circularly rolled or bent metallic strip is known from the document European Patent No. 1 062 421 B 1. There, it is proposed to provide a longitudinal slot on the internal pole at a predefined distance in an effort to reduce eddy currents. This injector has generally proved to be successful. However, it would be desirable to achieve further cost advantages in the production of injectors.

SUMMARY

In contrast, the injector according to the present invention for injecting a fluid has the advantage that a magnetic circuit of a solenoid actuator of the injector is able to be made even less expensive. More specifically, an external magnetic circuit component of a magnetic circuit need no longer be produced from a cylindrical solid material by machining. According to the present invention, it is provided that the external magnetic circuit component is developed from a strip material in the form of a rolled magnetic sleeve. Rolling the rectangular strip material thus makes it possible to provide a very cost-advantageous production method for the external magnetic circuit component. In particular, it also considerably simplifies the extrusion-coating of a coil disposed in the external magnetic circuit component. Furthermore, a very robust solenoid circuit for the solenoid actuator is able to be ensured.

In a particularly preferred manner, the rolled magnetic sleeve has a single layer. The rolled magnetic sleeve has a first and a second abutting edge, which rest against each other in the rolled state of the magnetic sleeve. This ensures a minimum gap of the rolled magnetic sleeve between the abutting edges.

In a particularly preferred manner, the first abutting edge has at least one projecting region, and the second abutting edge has a recess, which is developed according to the projecting region. In the rolled state of the magnetic sleeve, the projecting region is disposed in the recess by a keyed connection.

In an especially preferred manner, the projecting region has a constriction. This results in a secure, keyed connection between the projecting region and the correspondingly developed recess in the form of a puzzle piece. During the assembly of the rolled external magnetic circuit component, it is therefore possible to ensure that the rolled magnetic sleeve does not accidentally open.

According to an alternative development of the present invention or in addition to the keyed connection at the abutting edges, a welded connection is additionally provided at the rolled magnetic sleeve in order to connect the first abutting edge to the second abutting edge. Two welding points located at the respective ends of the rolled magnetic sleeve in the axial direction are especially preferred.

According to an alternative development of the present invention, it is also possible to use an open magnetic sleeve if it is ensured by a suitable device during the assembly that the magnetic sleeve does not accidentally open. The open magnetic sleeve is preferably slotted in the longitudinal direction.

According to a further preferred embodiment of the present invention, the rolled magnetic sleeve has a recess at a first end situated in the axial direction of the injector. With the aid of the recess, it is possible to achieve a more compact design of the injector.

In an especially preferred manner, the coil includes electrical connection elements, in particular two pins, which are at least partially surrounded by a housing section, the housing section being at least partially disposed in the recess of the rolled magnetic sleeve. This makes it possible to achieve a more compact and space-saving design in an uncomplicated manner.

The recess in the rolled magnetic sleeve is most preferably provided in the region of the first and the second abutting edges of the magnetic sleeve.

It is furthermore preferred that the actuator also includes a bottom region, which is disposed on an injector housing in a manner that projects in the form of a ring. The bottom region is preferably connected to the rolled magnetic sleeve in a material-connecting manner at a second end of the magnetic sleeve disposed in the axial direction. The material-connecting connection is preferably a welded connection. The connection has to ensure a magnetic flux in this case.

In addition, the actuator preferably includes a cover, which is connected to the rolled magnetic sleeve at the first end of the magnetic sleeve situated in the axial direction. This connection between the cover and the magnetic sleeve is likewise developed in a material-connecting manner and in particular, is preferably developed as a welded connection.

The cover preferably has a slot which extends in the axial direction of the injector and is disposed at the recess of the rolled magnetic sleeve. This allows for the realization of an even more compact design because the housing section that surrounds the connection elements of the coil is also able to be accommodated in the slot of the cover.

According to a further preferred development of the present invention, the coil includes a separate extrusion coat. This makes it possible to further increase a fluid tightness of the coil. For the assembly, the already extrusion-coated coil is introduced into the rolled magnetic sleeve and subsequently tightly extrusion-coated by a final extrusion coat at a sealing point provided on the coil, or the internal region of the magnetic sleeve with the installed coil is extrusion-coated once again. As a result, it is possible to achieve twice the reliability with regard to a tightness of the coil.

It is furthermore preferred that the bottom of the magnetic circuit is preferably developed as one piece together with the injector housing.

In a particularly preferred manner, the injector according to the present invention is a fuel injector for the injection of fuel. The injector may be mounted as a directly injecting injector directly on a combustion chamber or also as an injector for the injection at an intake region of a combustion engine.

DETAILED DESCRIPTION

Figure 1:
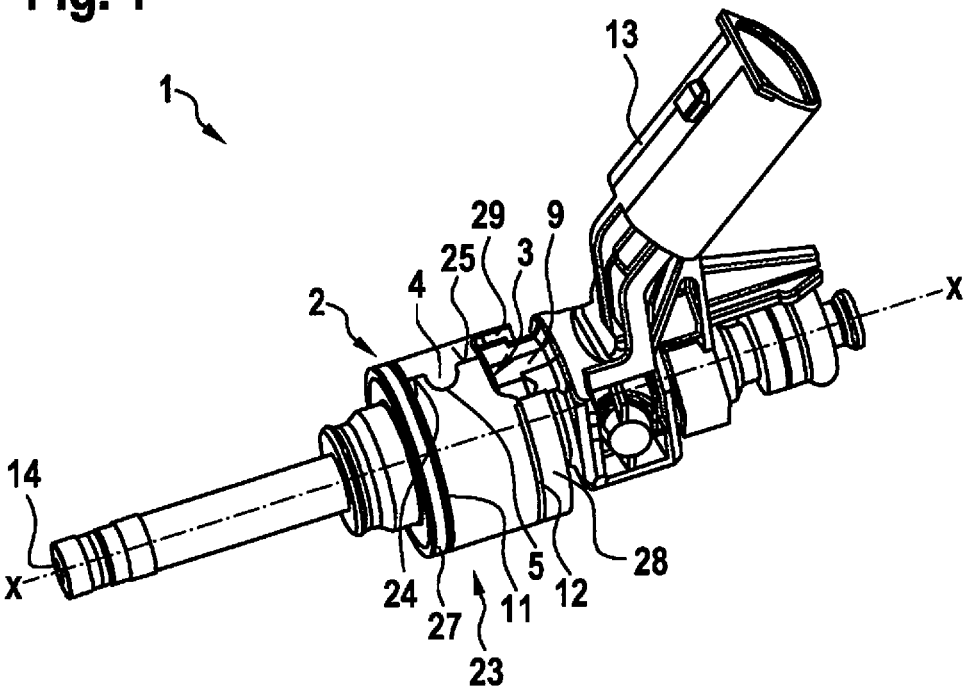
FIG. 1 shows a schematic, perspective view of an injector according to a first exemplary embodiment of the present invention.

In the following text, an injector 1 according to a first preferred exemplary embodiment of the present invention will be described in detail with reference to FIGS. 1 through 3. As may be gathered from the perspective overall view in FIG. 1, injector 1 includes a solenoid actuator 2 for operating a closing element 14, which is disposed at an end in axial direction X-X of injector 1. Closing element 14 is connected to an armature 21, which is able to be moved by solenoid actuator 2.

In addition to armature 21, solenoid actuator 2 also includes an internal pole 22 (compare FIG. 2), a separating ring 26, and an external magnetic circuit component, which is provided in the form of a rolled magnetic sleeve 23.

Rolled magnetic sleeve 23 is cylindrical and rolled from a rectangular strip material. The rolled magnetic sleeve has one layer and a first abutting edge 24 and a second abutting edge 25. The first and second abutting edges 24, 25 rest against each other in the rolled state of the magnetic sleeve.

In order to simplify an assembly of the rolled magnetic sleeve and in particular to avoid a gap between the two abutting edges 24, 25, magnetic sleeve 23 has a projecting region 4 and a recess 5. As is able to be gathered from FIGS. 1 and 3, a keyed connection is provided between projecting region 4 and recess 5. Projecting region 4 of this exemplary embodiment has a semicircular shape and transitions to first abutting edge 24 by way of a straight neck region. In a geometrically corresponding manner, recess 5 is formed on second abutting edge 25 in order to allow for a keyed connection between projecting region 4 and recess 5.

In addition, magnetic sleeve 23 includes a recess 3 in axial direction X-X. As may be gathered from FIG. 1, recess 3 is developed in the region of first and second abutting edges 24, 25.

Furthermore, the magnetic circuit of solenoid actuator 2 includes two electrical connection elements 8 in the form of pins. Electrical connection elements 8 are partially extrusion-coated (see FIG. 3) with the aid of a housing section 9. Housing section 9 of electrical connection elements 8 is at least partially disposed in recess 3 in rolled magnetic sleeve 23. This makes it possible to achieve a particularly compact design.

After solenoid actuator 2 has been assembled, a plug receptacle is also injection-molded onto electrical connection elements 8.

In addition, solenoid actuator 2 includes a bottom region 27 and a cover 28. Cover 28 is situated at a first end of magnetic sleeve 23 disposed in axial direction X-X of the injector. Bottom region 27 is situated at a second end of magnetic sleeve 23 disposed in axial direction X-X. As may be gathered especially from FIG. 3, cover 28 includes a slot 29. Slot 29 has a width in the circumferential direction that corresponds to a width of recess 3 in magnetic sleeve 23. This makes it possible to achieve an uncomplicated accommodation of housing section 9 of electrical connection elements 8.

Figure 2:
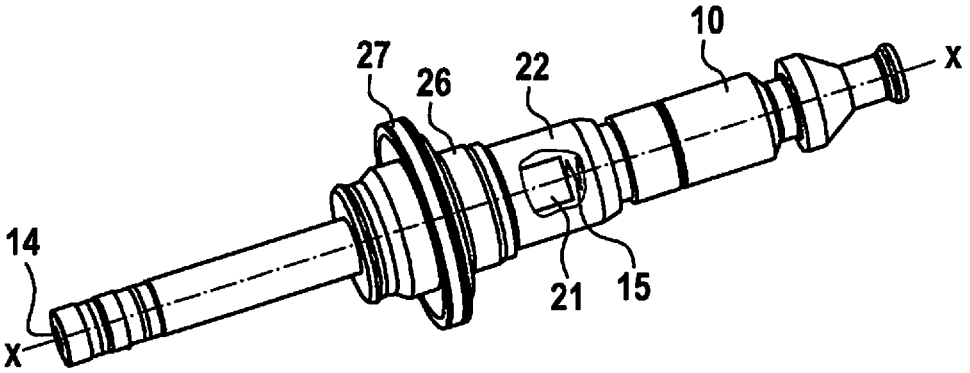
FIG. 2 shows a schematic view of the injector from FIG. 1 without an assembled magnetic circuit.
Figure 3:
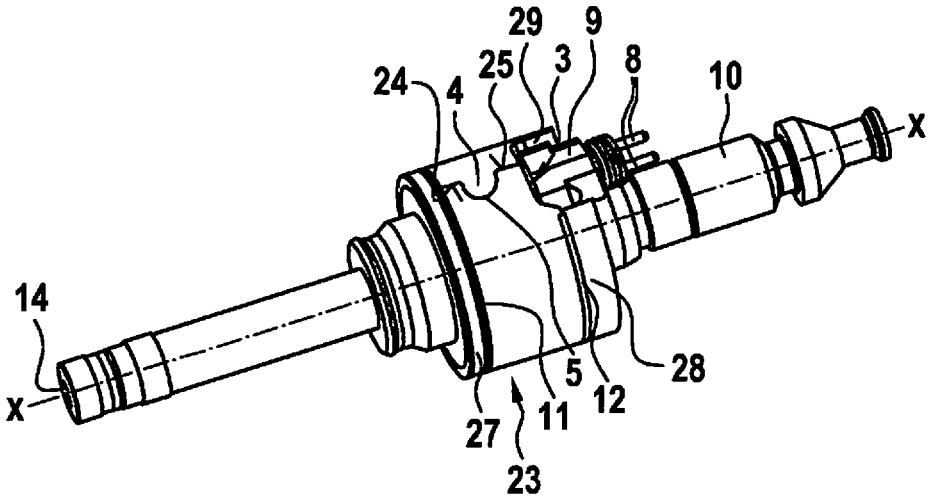
FIG. 3 shows a schematic view of the injector from FIG. 1 with an assembled magnetic circuit.

Moreover, it is clear from FIGS. 1 and 3 that bottom region 27 is connected to magnetic sleeve 23 with the aid of a first welded joint 11. First welded joint 11 is provided along the circumference and surrounds it completely. Furthermore, cover 28 is connected by a second welded joint 12 to magnetic sleeve 23. Second welded joint 12 is also fully developed in the circumferential direction between cover 28 and magnetic sleeve 23.

Closing element 14 is connected to armature 21 (see FIG. 2), and a restoring element 15 always resets closing element 14 to the neutral state in which solenoid actuator 2 is not actuated.

According to the present invention, a rolled magnetic sleeve 23 may therefore be provided, which is able to be produced in a very cost-effective manner and be rolled from a rectangular strip material. A keyed connection, including projecting region 4 and a geometrically correspondingly developed recess 5, are provided in order to ensure a secure connection of the abutting edge regions of rolled magnetic sleeve 23. This simplifies in particular an assembly of solenoid actuator 2. The coil of solenoid actuator 2 may furthermore include a separate extrusion coat and be inserted into rolled magnetic sleeve 23; prior to assembling cover 28, an additional extrusion coat may be provided in the interior region between magnetic sleeve 23 and the coil in an effort to achieve better tightness. In a final step, cover 28 is then fixed in place on magnetic sleeve 23.

Figure 4:
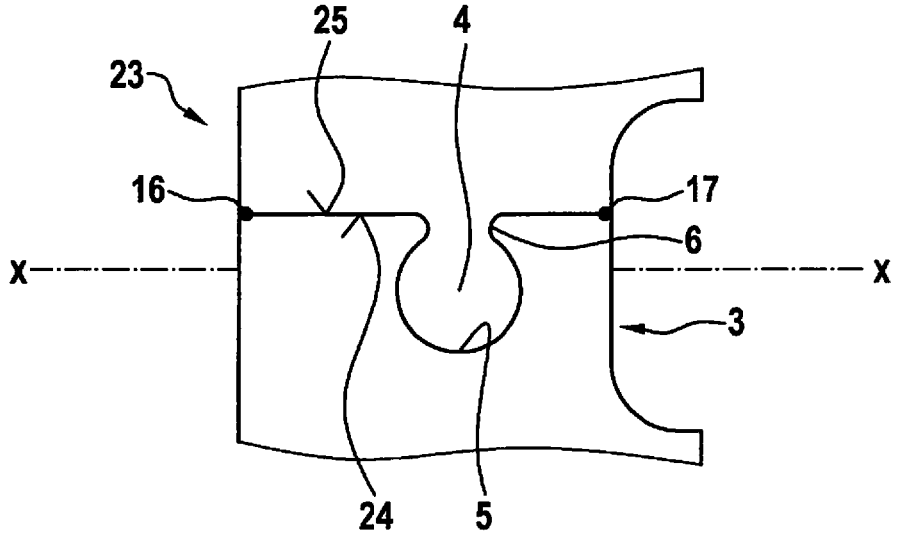
FIG. 4 shows a schematic view of a magnetic sleeve of a solenoid actuator according to a second exemplary embodiment of the present invention.

FIG. 4 shows an alternative development of a keyed connection of an injector according to a second exemplary embodiment of the present invention. As may be gathered from FIG. 4, a constriction 6 is provided in the keyed connection between projecting region 4 and recess 5 at both abutting edges 24, 25. As a result, projecting region 4 has the shape of a puzzle piece, which makes it possible to achieve a particularly reliable keyed connection between the two free ends of rolled magnetic sleeve 23 in the circumferential direction.

In addition, a welded joint is provided between first abutting edge 24 and second abutting edge 25, which includes a first welding point 16 and a second welding point 17 in this particular exemplary embodiment. The two welding points are provided at abutting edges 24, 25 at the ends disposed in the axial direction X-X in each case.

As a result, an injector is able to be provided according to the present invention, which has a particularly cost-effective solenoid actuator. In a particularly preferred manner, the injector is used for the injection of fuel into a combustion engine.

What is claimed is:

1. An injector for an injection of a fluid, comprising:

a closing element that releases and closes a through opening; and a solenoid actuator for operating the closing element, wherein:

the solenoid actuator includes an armature connected to the closing element, an internal pole, and an external magnetic circuit component, and the magnetic circuit component is a magnetic sleeve rolled from a strip material, wherein:

the rolled magnetic sleeve has a single layer and includes a first abutting edge and a second abutting edge that rest against each other in a rolled state of the magnetic sleeve, the solenoid actuator includes a bottom region disposed on an injector housing in a manner that projects as a ring and that is connected to the rolled magnetic sleeve at a second end of the magnetic sleeve disposed in the axial direction of the injector, the solenoid actuator includes a cover connected to the rolled magnetic sleeve at a first end of the magnetic sleeve situated in an axial direction, and the cover includes a slot that extends in the axial direction and is disposed at a recess of the rolled magnetic sleeve that is developed in a region of the first abutting edge and the second abutting edge, wherein a width in a circumferential direction of the slot corresponds to a width of the recess.

2. The injector as recited in claim 1, wherein the fluid is a fuel.

3. The injector as recited in claim 1, wherein:

the first abutting edge has at least one projecting region, the second abutting edge has at least one recess, and the projecting region is disposed in the recess via a keyed connection in the rolled state of the magnetic sleeve.

4. The injector as recited in claim 3, wherein the projecting region has a constriction.

5. The injector as recited in claim 1, wherein the first abutting edge is connected to the second abutting edge via a welded joint.

6. The injector as recited in claim 1, wherein the recess is disposed at a first end in an axial direction of the injector.

7. The injector as recited in claim 6, wherein:

the solenoid actuator includes electrical connection elements that are at least partially surrounded by a housing section, and the housing section is at least partially disposed in the recess.

8. The injector as recited in claim 1, wherein at least one of:

a first welded joint is provided between the bottom region and the magnetic sleeve, and a second welded joint is provided between the cover and the magnetic sleeve.

* * * * *